US008132898B2

(12) United States Patent
Fukazawa et al.

(10) Patent No.: US 8,132,898 B2
(45) Date of Patent: Mar. 13, 2012

(54) RECORDING HEAD AND RECORDING APPARATUS

(75) Inventors: Hideo Fukazawa, Chigasaki (JP); Toshiro Sugiyama, Yokohama (JP); Shigeru Watanabe, Yokohama (JP); Kouhei Tokuda, Yokohama (JP); Tsuyoshi Mikoshiba, Yokohama (JP); Takeshi Kouda, Kawasaki (JP); Masaya Uetsuki, Yokohama (JP); Toshimitsu Danzuka, Tokyo (JP); Hiroaki Shirakawa, Kawasaki (JP); Masataka Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 12/487,393

(22) Filed: Jun. 18, 2009

(65) Prior Publication Data

US 2009/0315959 A1 Dec. 24, 2009

(30) Foreign Application Priority Data

Jun. 19, 2008 (JP) ..... 2008-160768

(51) Int. Cl.
*B41J 2/175* (2006.01)

(52) U.S. Cl. ..... 347/85

(58) Field of Classification Search ..... 347/84, 347/85, 92
See application file for complete search history.

(56) References Cited

U.S. PATENT DOCUMENTS

| | | | | |
|---|---|---|---|---|
| 6,007,193 | A * | 12/1999 | Kashimura et al. | 347/92 |
| 6,471,343 | B1 * | 10/2002 | Shimizu et al. | 347/85 |
| 6,840,611 | B2 * | 1/2005 | Kudo et al. | 347/86 |
| 7,150,519 | B2 | 12/2006 | Kono | |
| 2001/0008937 | A1 | 7/2001 | Callegaro | |

FOREIGN PATENT DOCUMENTS

| | | |
|---|---|---|
| JP | 7-266571 | 10/1995 |
| JP | 2006-159482 | 6/2006 |
| WO | 98/08876 | 3/1998 |

* cited by examiner

*Primary Examiner* — Anh T. N. Vo
(74) *Attorney, Agent, or Firm* — Canon USA Inc. IP Division

(57) ABSTRACT

A recording head includes ejection ports that eject ink, a first liquid chamber for supplying ink to the ejection ports, a second liquid chamber for supplying ink to the first liquid chamber, a gas reservoir disposed in the upper part of the first liquid chamber and collecting gas, a first outlet through which fluid is discharged out of the gas reservoir, and a pump chamber into which fluid is moved through the first outlet out of the first liquid chamber by producing a pressure difference from the first liquid chamber.

9 Claims, 12 Drawing Sheets

RECORDING HEAD AND RECORDING APPARATUS

BACKGROUND OF THE INVENTION

1.Field of the Invention

The present invention relates to a recording head that ejects ink to perform recording, and more specifically, it relates to a recording head having a mechanism for removing accumulated air that causes defective ink ejection, and a recording apparatus.

2.Description of the Related Art

Ink jet recording apparatuses have an ink jet recording head mounted on a carriage reciprocating above a recording medium. When the recording head reciprocates above a recording medium, an ejection section of the recording head is driven, ink is ejected from ejection ports of the recording head, and an image or characters are formed on the recording medium. The recording head is supplied with ink from an ink supply container (hereinafter referred to as ink tank).

Some recording apparatuses have a detachable ink tank. Ink is supplied from the ink tank to a recording head through a tube.

In general, a recording head is located above a recording medium in the direction of gravitation and downward ejects ink droplets. It is preferable that the inside of the recording head be maintained at a negative pressure slightly lower than the atmospheric pressure, and the ink in each ejection nozzle form a meniscus.

Air in a recording head can cause trouble in an ink jet recording apparatus. Air in a recording head prevents ink from being supplied to the recording head. Supplying air instead of ink to an ejection section results in defective recording. The air in the recording head changes its volume with changing ambient temperature. With changing volume of the air in the recording head, the inside of the recording head maintained at a negative pressure slightly lower than the atmospheric pressure can be put under positive pressure. In the case of a recording head having nozzles facing downward, if the inside of the recording head is put under positive pressure, it becomes difficult to maintain meniscuses, and ink can flow out of the nozzles.

The entry of air into a recording head occurs in the following cases.

When an ink tank is replaced, and when a connector portion of a supply tube connected with the ink tank is temporarily opened to the atmosphere, air enters the supply tube through the connector portion. Specifically, in a configuration in which a supply tube is passed through a rubber plug of an ink tank, the open end of the supply tube is exposed to the atmosphere when the ink tank is replaced. Through the open end, air can enter the supply tube. After a new ink tank is attached, the air that has entered the supply tube is supplied through the tube to a recording head.

Air can also enter a tube constituting an ink path through the wall of the tube over a long time, and the air can be sent together with ink to a recording head and can stay in the recording head. A tube used for supplying ink to a recording head mounted on a carriage that reciprocates, is required to have flexibility and therefore is formed of a resin material having a low gas permeability, such as polyethylene. However, when an apparatus is unused for a long time, a small amount of air passes through the wall of the tube. The air that has entered the tube is introduced into the recording head by recording operation.

Air dissolved in ink can accumulate due to changes in ambient condition. Air dissolved in ink accumulates due to changes in temperature or pressure caused by ejection, and forms bubbles around an ejection section.

Air enters a recording head through nozzles during ink ejection. Air also enters a recording head when the air in the recording head changes its volume with decreasing ambient temperature and a larger-than-normal negative pressure breaks meniscuses.

The accumulated air in a recording head changes its volume with decreasing ambient temperature, and further air is taken in through nozzles.

WO 98/08876 discloses the idea that a recording head has a space for holding air, and the time to replace the recording head is designed by considering the amount of entering air and the time when trouble occurs.

Japanese Patent Laid-Open No. 7-266571 discloses a recording head that is mounted on a carriage and provided with an ink inlet tube, an ink outlet tube, and a pump. By circulating air between the recording head and an ink tank, air bubbles in the recording head is forced to flow into the ink tank.

Japanese Patent Laid-Open No. 2006-159482 discloses a configuration to easily discharge air bubbles in a filter for removing foreign substances disposed in an ink flow passage.

U.S. Pat. No. 7,150,519 discloses the state of air accumulated in a recording head, how to fill the recording head with ink, and how to remove the accumulated air. Ink jet recording apparatuses are required to perform high-definition recording at high speed on large-sized recording paper. Therefore, the frequency of replacing recording heads increases, and the length of a tube that supplies ink from an ink tank to a recording head increases. Consequently, the amount of air entering during replacement of an ink tank, and the amount of air entering an ink flow passage through the wall of the tube, also increase. In addition, increasing the number of nozzles for high-speed recording results in an increase in the amount of air entering through nozzles.

In the case of a configuration in which entering air is held in a recording head as described in WO 98/08876, an increase in the amount of air entering a tube that supplies ink from an ink tank to the recording head and the amount of air entering the recording head through nozzles leads to an increase in the size of the recording head and results in an increase in the size of the apparatus.

In the case of the configuration of WO 98/08876, if the size of the recording head, in which entering air is held, is not increased, the frequency of replacing recording heads increases.

Recent ink jet recording apparatuses have a large recording width and require high-rate ink supply. Some of them need pressurized supply of ink from an ink tank to a recording head. In the case of pressurized supply of ink to a recording head, it has become necessary to provide the recording head with a negative pressure generator and to remove air that has entered the recording head.

In the configuration of Japanese Patent Laid-Open No. 7-266571, ink is returned from a recording head to an ink tank by a pump attached to the recording head, and at the same time, air accumulated in the recording head is sent to the ink tank. Therefore, in the configuration of Japanese Patent Laid-Open No. 7-266571, air is not completely discharged to the outside of the recording head and the supply system.

U.S. Pat. No. 7,150,519 discloses a configuration in which a suction cap is brought into contact with ejection ports of a recording head and air is forcibly sucked out of the recording head. In the configuration of U.S. Pat. No. 7,150,519, ink is sucked together with air, and therefore ink is wasted.

SUMMARY OF THE INVENTION

The present invention reduces the amount of ink discharged when air is discharged out of a recording head.

In an aspect of the present invention, a recording head includes ejection ports that eject ink, a first liquid chamber for supplying ink to the ejection ports, a second liquid chamber for supplying ink to the first liquid chamber, a gas reservoir disposed in the upper part of the first liquid chamber and collecting gas, a first outlet through which fluid is discharged out of the gas reservoir, and a pump chamber into which fluid is moved through the first outlet out of the first liquid chamber by producing a pressure difference from the first liquid chamber.

Further features of the present invention will become apparent from the following description of exemplary embodiments with reference to the attached drawings.

DESCRIPTION OF THE EMBODIMENTS

First Embodiment

The embodiments of the present invention will now be described with reference to the drawings.

Figure 10:
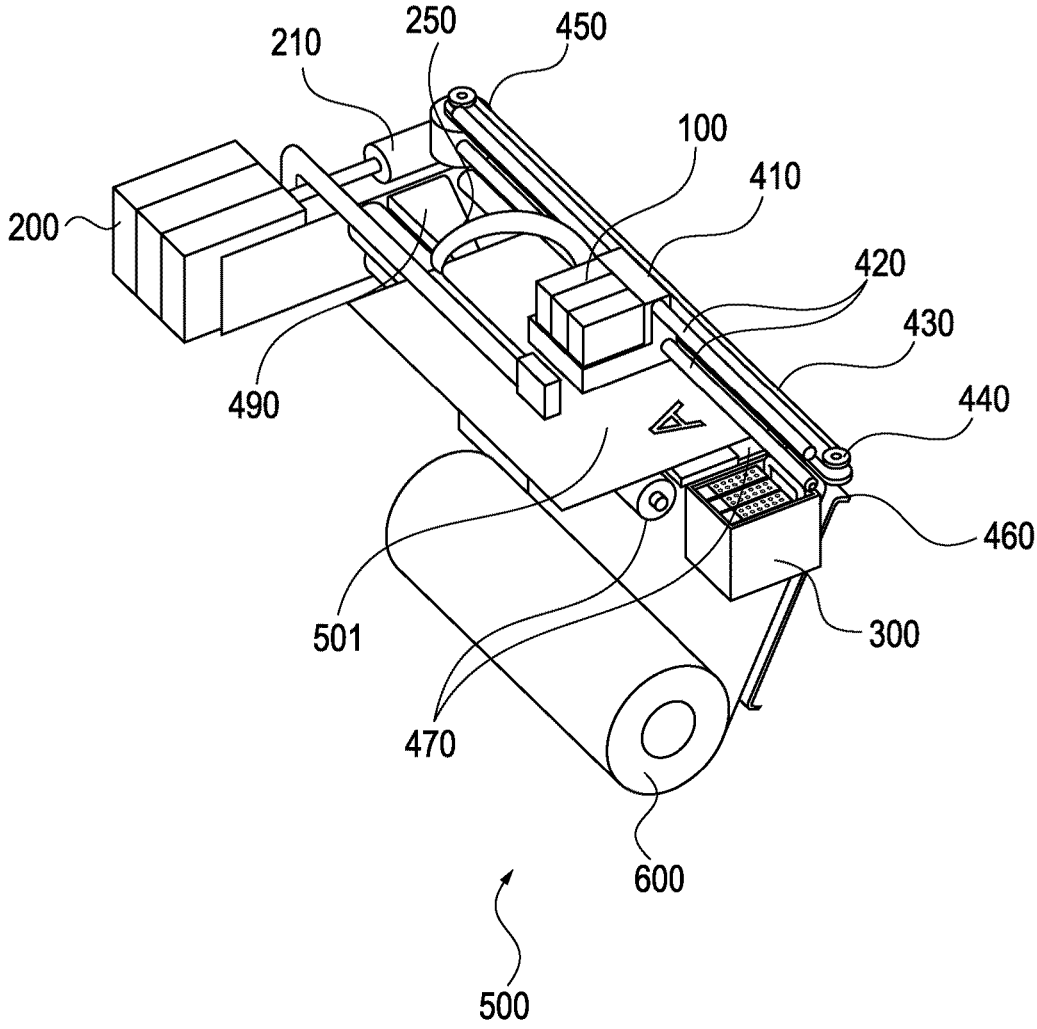
FIG. 10 is a perspective view showing a recording apparatus to which the present invention can be applied.

FIG. 10 is a perspective view showing a recording-related configuration of an ink jet recording apparatus 500 to which the present invention can be applied.

The ink jet recording apparatus 500 has an ink tank 200 detachable from the main body of the apparatus, and a recording head 100 connected with the ink tank 200 by a tube 250. Ink pushed out of the ink tank 200 by a pressurizing pump 210 is supplied through the tube 250 to the recording head 100.

The recording head 100 is mounted on a carriage 410. The carriage 410 is movable, guided by a slide shaft 420. The carriage 410, on which the recording head 100 is mounted, is attached to a CR belt 430 looped over pulleys 440. By driving the CR belt 430 using a carriage motor 450, the carriage 410 is reciprocated, facing the recording surface of recording paper 601, and guided by the slide shaft 420.

Outside the area through which recording paper is conveyed, a recovery system 300 is disposed that sucks ink out of the recording head 100 using a suction unit such as a tube pump (not shown) so as to maintain the ejecting performance of the recording head 100. The recovery system 300 brings a suction cap 310 into contact with the ejection port surface of the recording head, and sucks ink out of ejection ports (not shown) using negative pressure that the suction unit generates. By the suction by the recovery system 300, thickened ink and bubbles in the ejection ports are sucked out, and trouble such as defective ejection is fixed.

A roll of recording medium 600 rotatably supported in the lower part of the recording apparatus is conveyed by a conveyance guide 460 and a conveying roller group 470 onto the upper surface of a platen 490. The upper surface of the platen 490 is the recording position. The recording head facing the recording medium ejects ink while reciprocating over the recording medium, and the conveying roller group 470 intermittently conveys the recording medium 600. In this way, an image is formed on the recording medium.

Figure 1:
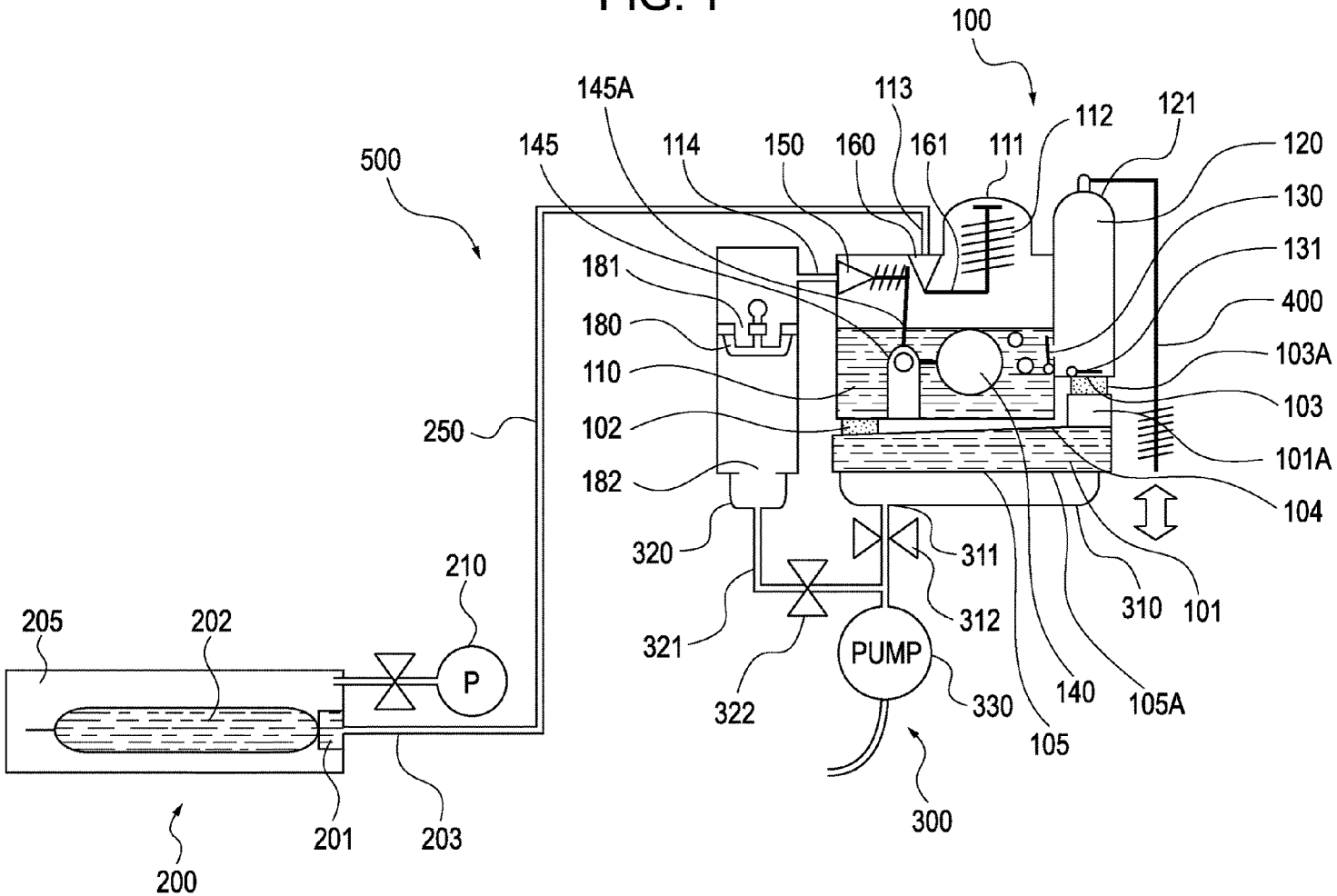
FIG. 1 illustrates an ink supply system according to a first embodiment of the present invention.

FIG. 1 illustrates an ink supply system according to a first embodiment of the present invention.

An ink tank 200 includes a bag 202 formed of a flexible material, a rubber plug 201 that seals the ink outlet, and a hermetic case 205 that houses the bag 202. At one end of a tube 250 is provided an ink needle 203 that is pointed and hollow. Sticking the ink needle 203 into the rubber plug 201 enables ink to be forced out of the ink tank 200 into the tube 250.

When the ink needle 203 is stuck into the rubber plug, a pressurizing pump 210 is connected to the hermetic case 205.

The pressurizing pump 210 pumps air into the hermetic case 205, thereby pressurizing the space around the bag 202. The ink in the bag 202 and in the tube 250 is pressurized by the air in the hermetic case 205.

The pressurizing pump 210, the hermetic case 205, the bag 202, and the tube 250 constitute a supply unit that supplies ink under pressure to the recording head 100.

A recording head 100 has a first liquid chamber 101 and a second liquid chamber 110. The first liquid chamber 101 has an orifice plate 105 that has a plurality of ejection ports 105A that face downward in the direction of gravitation. The second liquid chamber 110 is disposed above the first liquid chamber 101 in the direction of gravitation and has a negative pressure generator.

The second liquid chamber 110 has a supply port 113 through which ink flows in from the tube 250.

The second liquid chamber 110 is connected to the first liquid chamber 101 by an ink flow passage 102 that has a filter therein. Ink is supplied from the second liquid chamber 110 through the ink flow passage 102 to the first liquid chamber 101.

The negative pressure generator has a liquid chamber diaphragm 111 and a diaphragm spring 112 that urges the liquid chamber diaphragm 111 so as to deform it.

The liquid chamber diaphragm 111 constitutes a part of a wall that defines the second liquid chamber 110. The outer side of the liquid chamber diaphragm 111 is exposed to the atmosphere.

The diaphragm spring 112 urges the liquid chamber diaphragm 111 so that the liquid chamber diaphragm 111 swells toward the atmosphere side.

Since the diaphragm spring 112 urges the liquid chamber diaphragm 111 so as to increase the volume of the second liquid chamber 110, the pressure in the second liquid chamber 110 becomes slightly lower than the atmospheric pressure (by about 80 mmAq). This negative pressure state will be referred to as first negative pressure state.

Putting the second liquid chamber 110 in the first negative pressure state puts the first liquid chamber 101, which is hermetically connected to the second liquid chamber 110, in the first negative pressure state. Putting the first liquid chamber 101 in the first negative pressure state forms an excellent meniscus in each of the ejection ports 105A.

The supply port 113 and a supply control valve 160 that opens and closes the supply port 113 constitute a supply control unit.

The supply control valve 160 opens and closes the supply port in conjunction with the negative pressure generator. The supply control valve 160 operates integrally with the liquid chamber diaphragm 111, with an arm 161 therebetween. The supply control valve 160, subjected to spring force by the diaphragm spring 112, closes the supply port 113.

Ejecting ink from the ejection ports reduces the amount of ink in the recording head and depressurizes the second liquid chamber 110. When the pressure in the second liquid chamber 110 falls below the first negative pressure state, the atmospheric pressure overcomes the urging force of the diaphragm spring 112 and deforms the liquid chamber diaphragm 111 so that the volume of the second liquid chamber 110 decreases. The deformation of the liquid chamber diaphragm 111 moves the arm 161, thereby moving the supply control valve 160 in the opening direction.

When the supply control valve 160 opens the supply port 113, pressurized ink flows from the tube 250 into the second liquid chamber 110. The increase in the amount of ink in the recording head increases the pressure in the recording head. When the pressure in the recording head returns to the first negative pressure state, the liquid chamber diaphragm 111 returns to its original form, and the supply control valve 160 closes.

In a continuous recording operation in which ink is continuously ejected from the ejection ports, the supply control valve 160 performs intermittent opening and closing, and ink is stably supplied from the ink tank 200 through the tube 250 to the recording head.

The direction in which the ejection ports 105A are arranged will be referred to as longitudinal direction. At one end in the longitudinal direction of the first liquid chamber 101, an ink inlet is formed that is connected to the ink flow passage 102 having a supply filter. At the other end in the longitudinal direction of the first liquid chamber 101, a first outlet 103 is formed that has an outlet filter 103A.

In the upper part of the first liquid chamber 101, a sloping surface 104 is formed. Above the orifice plate 105, a one-way flow passage is formed. The sloping surface 104 constitutes a part of the ceiling surface of the one-way flow passage. On the lower side of the sloping surface 104 in the direction of gravitation, the ink inlet connected to the supply-side flow passage 102 is formed. On the upper side of the sloping surface 104, a gas reservoir 101A is formed. Above the gas reservoir 101A, the first outlet 103 having the outlet filter 103A is formed.

The first liquid chamber 101 and the second liquid chamber 110 are connected not only by the ink flow passage 102 but also through a pump chamber 120. By making the pressure in the pump chamber 120 lower than the pressure in the first liquid chamber 101, a fluid suction chamber is formed that sucks fluid through the first outlet 103 out of the first liquid chamber 101 into the pump chamber 120. In addition, the pump chamber 120 forms a circulation pathway through which ink is returned from the first liquid chamber 101 to the second liquid chamber 110.

Air accumulated in the first liquid chamber 101 is sent to the second liquid chamber 110 by a diaphragm pump.

The diaphragm pump has a liquid chamber diaphragm 121 that repeatedly increases and decreases the volume of the circulation pathway. The liquid chamber diaphragm 121 is formed of a flexible material, and is deformed so as to increase or decrease the volume of the pump chamber 120.

A second one-way valve 130 permits flow of ink from the pump chamber 120 to the second liquid chamber 110, and blocks flow of ink from the second liquid chamber 110 to the pump chamber 120. A first one-way valve 131 permits flow of ink from the first liquid chamber 101 to the pump chamber 120, and blocks flow of ink from the pump chamber 120 to the first liquid chamber 101.

The pump chamber 120, the liquid chamber diaphragm 121, the second one-way valve 130, and the first one-way valve 131 constitute a circulation unit that returns ink and bubbles from the first outlet 103 to the second liquid chamber 110.

An air vent flow passage 181 forms a discharge flow passage through which air bubbles are discharged from the second liquid chamber 110.

The air vent flow passage 181 is connected to the second liquid chamber 110 by a second outlet 114.

An umbrella valve 180 serves as a second discharge control valve that opens and closes the air vent flow passage 181 according to the pressure difference. The umbrella valve 180 is normally closed and insulates the first liquid chamber 101 and the second liquid chamber 110 from the atmosphere.

When the pressure in the air vent flow passage 181 is lower than the pressure in the second liquid chamber 110, the umbrella valve 180 permits liquid to be discharged through the second outlet 114. When the pressure in the air vent flow passage 181 is higher than the pressure in the second liquid chamber 110, the umbrella valve 180 blocks flow of fluid from the air vent flow passage 181 to the second outlet 114.

The second outlet 114 is intermittently opened and closed by a float valve 150 that serves as a gas-liquid separator. The float valve 150 functions as a first discharge control valve. The float valve 150 is opened and closed by a float 140 that rises and falls with the rise and fall of the level of ink.

The float valve 150 is provided at one end of an L-shaped link member 145A that rotates around a shaft 145. At the other end of the L-shaped link member 145A, the float 140 is provided.

When the level of the ink in the second liquid chamber 110 rises, buoyancy acts on the float 140. This buoyancy generates a moment that rotates the L-shaped link member 145A around the rotating shaft 145 counterclockwise in FIG. 1. When the level of ink rises to a position that is lower than the second outlet 114 by a predetermined height, the float valve 150 is pressed by this moment against the wall surface of the second liquid chamber 110 and closes the second outlet 114.

When the amount of ink in the second liquid chamber 110 decreases due to a recording operation, the float 140 falls with the fall of the level of ink, and the L-shaped link member 145A rotates clockwise around the rotating shaft 145. The float valve 150 opens the second outlet 114, and the second liquid chamber 110 comes into communication with the air vent flow passage 181.

Downstream of the air vent flow passage 181, an air vent port 182 is disposed, with which an air vent cap 320 is in contact.

A recovery system 300 includes a suction cap 310 for making the ejection ports recover from malfunctioning, the air vent cap 320 for discharging the air in the recording head, a pump 330, a first flow passage 311 and a first on-off valve 312 that connect the suction cap 310 and the pump 330, and a second flow passage 321 and a second on-off valve 322 that connect the air vent cap 320 and the pump 330. The pump 330 is a tube pump.

Next, a description will be given of flow of ink and workings of each part during a recording operation.

Initial Filling Operation

Figure 2:
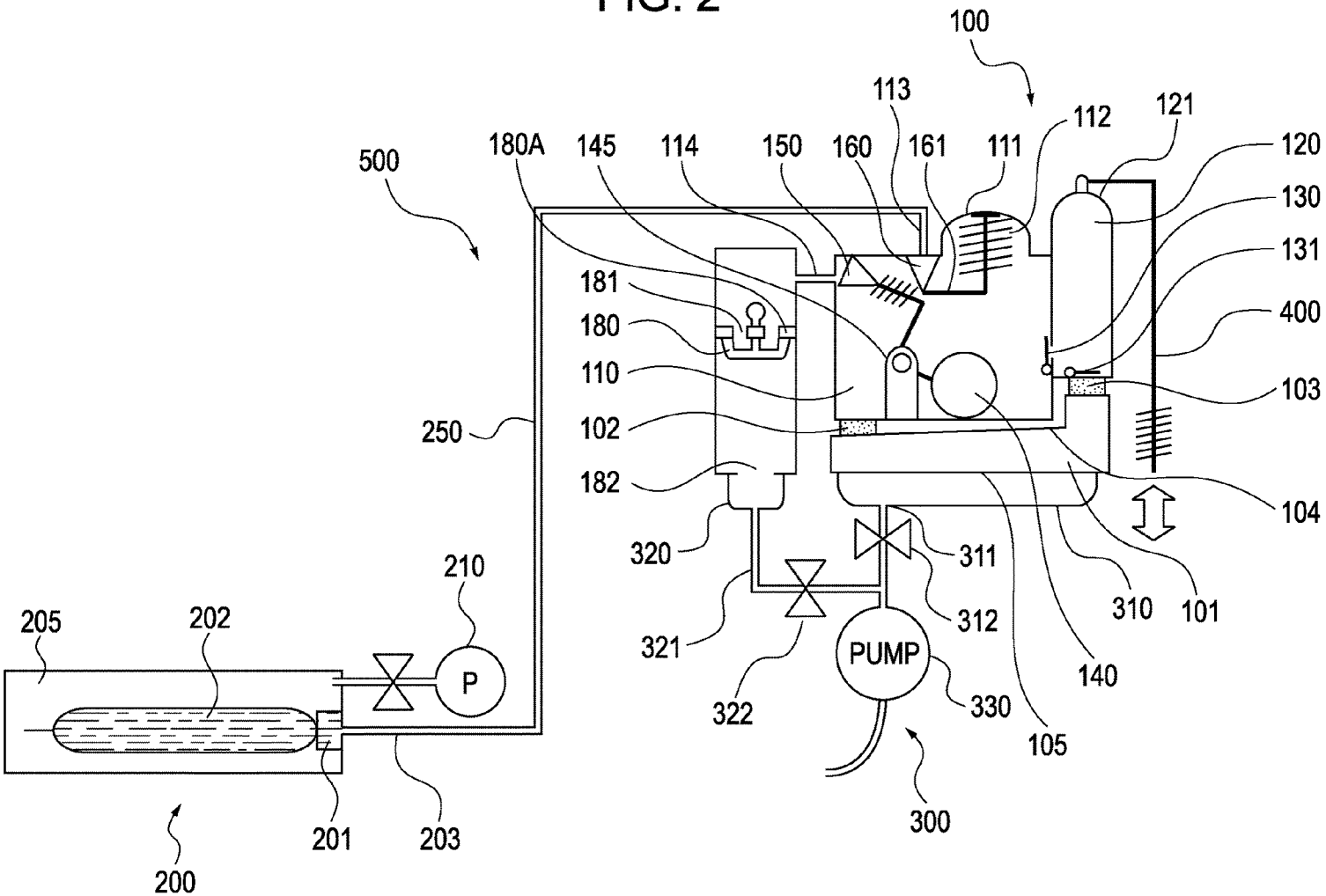
FIG. 2 shows a state in which a recording head is not yet filled with ink in a first embodiment.

FIG. 2 shows a state in which the recording head is not yet filled with ink in a first embodiment.

At the start of an initial filling operation, there is no ink in the tube 250, the first liquid chamber 101, and the second liquid chamber 110. The ink tank 200 is connected to the ink needle 203. The pressurizing pump 210 pressurizes the space around the bag 202 to enable the supply of ink.

The suction cap 310 is brought into contact with the ejection port surface of the recording head where there is the orifice plate 105, and the air vent cap 320 is brought into contact with the air vent port 182. The first on-off valve 312 is closed, and the second on-off valve 322 is open. The pump 330 generates a negative pressure (2000 mmAq lower than the atmospheric pressure) that is larger than the first negative pressure state (80 mmAq lower than the atmospheric pressure). This negative pressure will be referred to as second negative pressure. Due to the negative pressure that the pump 330 generates, the inside of the air vent cap 320 is put under negative pressure, and the umbrella valve 180 moves downward. This takes the umbrella valve 180 out of contact with a seal member 180A that is provided on the inner surface of the air vent flow passage 181. Thus, the umbrella valve 180 opens. The umbrella valve 180 functions as a second discharge control valve.

Since there is no ink in the second liquid chamber 110, the float 140 is at the lowest position, and the float valve 150 opens the second outlet 114. By the opening of the umbrella valve 180, the second liquid chamber 110 is also put in the second negative pressure state, and the liquid chamber diaphragm 111 contracts and opens the supply control valve 160. The inside of the tube 250 is also put under negative pressure, and the ink in the ink tank 200 is introduced into the second liquid chamber 110. The ink introduced into the second liquid chamber 110 flows into the first liquid chamber 101 located below the second liquid chamber 110 in the direction of gravitation.

Figure 3:
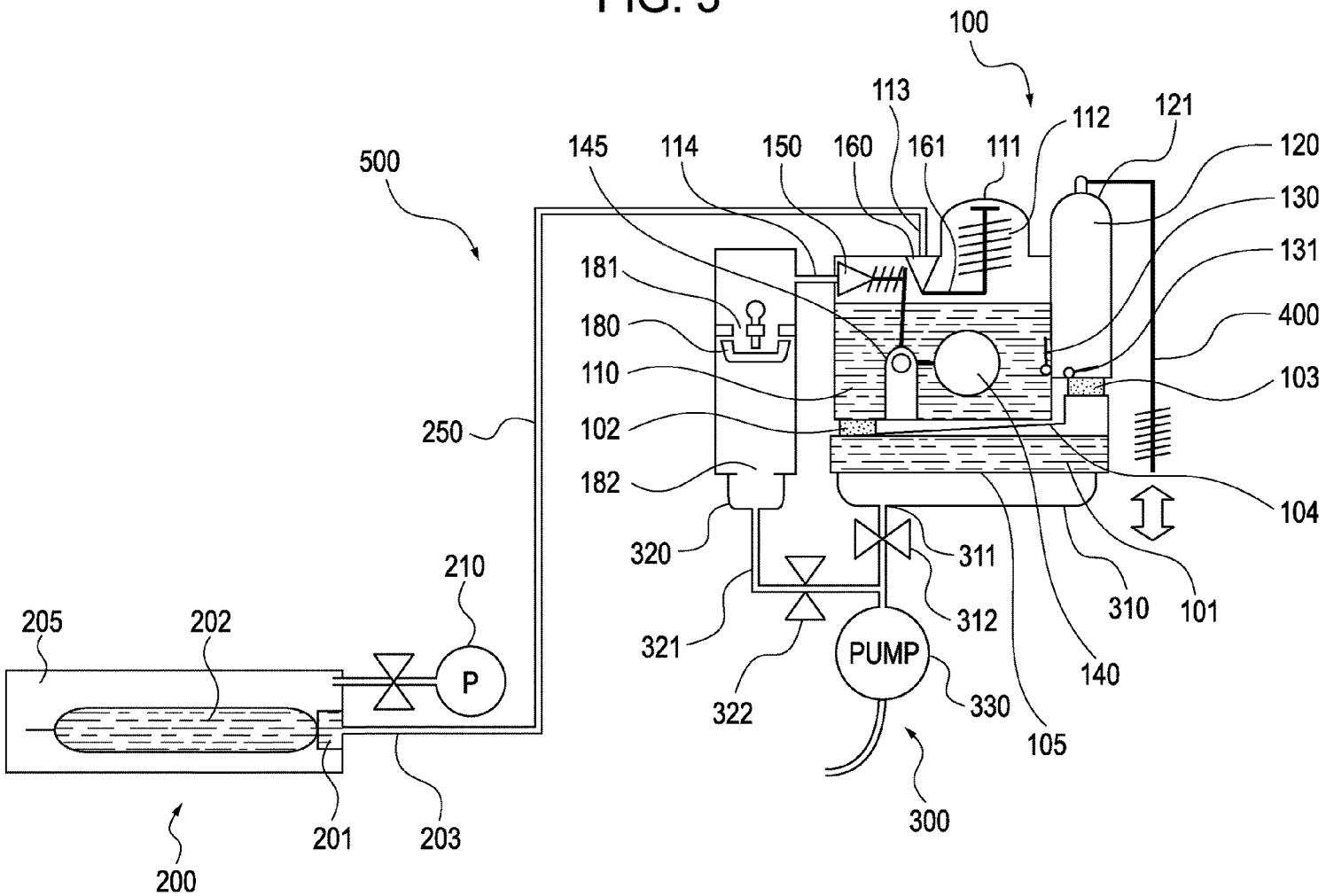
FIG. 3 shows a state in which a recording head is being filled with ink in a first embodiment.

As the amount of ink in the second liquid chamber 110 increases, the float 140 rises, and the float valve 150 closes the second outlet 114 as shown in FIG. 3.

In the state shown in FIG. 3, there is air in the first liquid chamber 101. Next, by performing an air removal operation, the air in the first liquid chamber 101 is sent to the second liquid chamber 110.

The air removal operation will be described briefly prior to describing it in detail.

Figure 7:
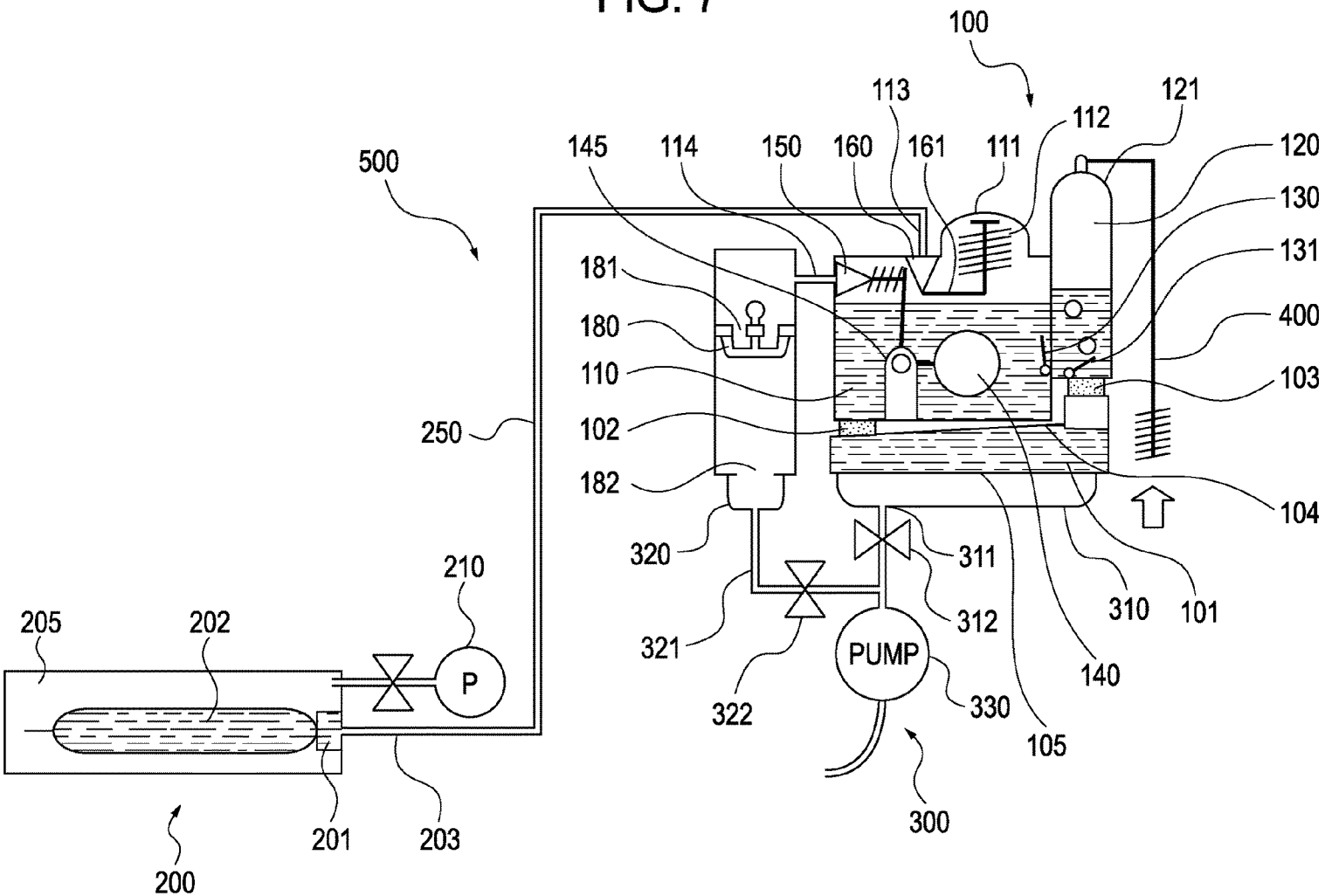
FIG. 7 shows an operation to remove air accumulated in a first liquid chamber in a first embodiment.
Figure 8:
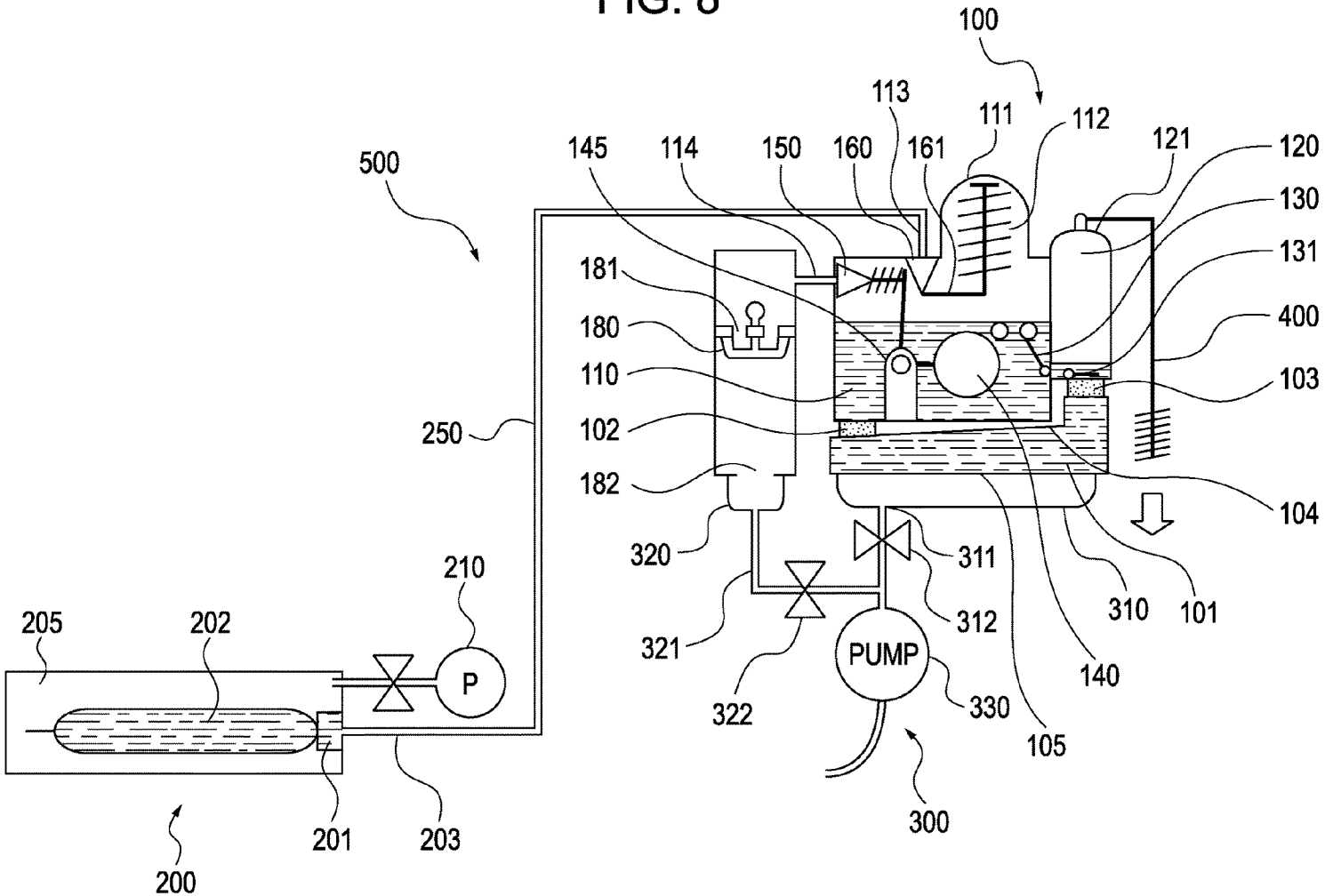
FIG. 8 shows an operation to remove air accumulated in a pump chamber in a first embodiment.

The air removal operation is performed by deforming the liquid chamber diaphragm 121 upward and downward using a driving unit (not shown) so that the volume of the pump chamber 120 is repeatedly increased as shown in FIG. 7 and decreased as shown in FIG. 8.

Deforming the liquid chamber diaphragm 121 upward as shown in FIG. 7 decreases the pressure in the pump chamber 120, and the air in the first liquid chamber 101 is sucked through the first outlet 103 into the pump chamber 120. As the amount of air in the first liquid chamber 101 decreases, ink is supplied to the first liquid chamber 101 from the second liquid chamber 110.

Deforming the liquid chamber diaphragm 121 downward as shown in FIG. 8 increases the pressure in the pump chamber 120, and air is forced out of the pump chamber 120 into the second liquid chamber 110 through the second one-way valve 130. At the same time, ink is supplied from the second liquid chamber 110 to the first liquid chamber 101.

By repeating this, the first liquid chamber 101 is filled with ink.

Figure 4:
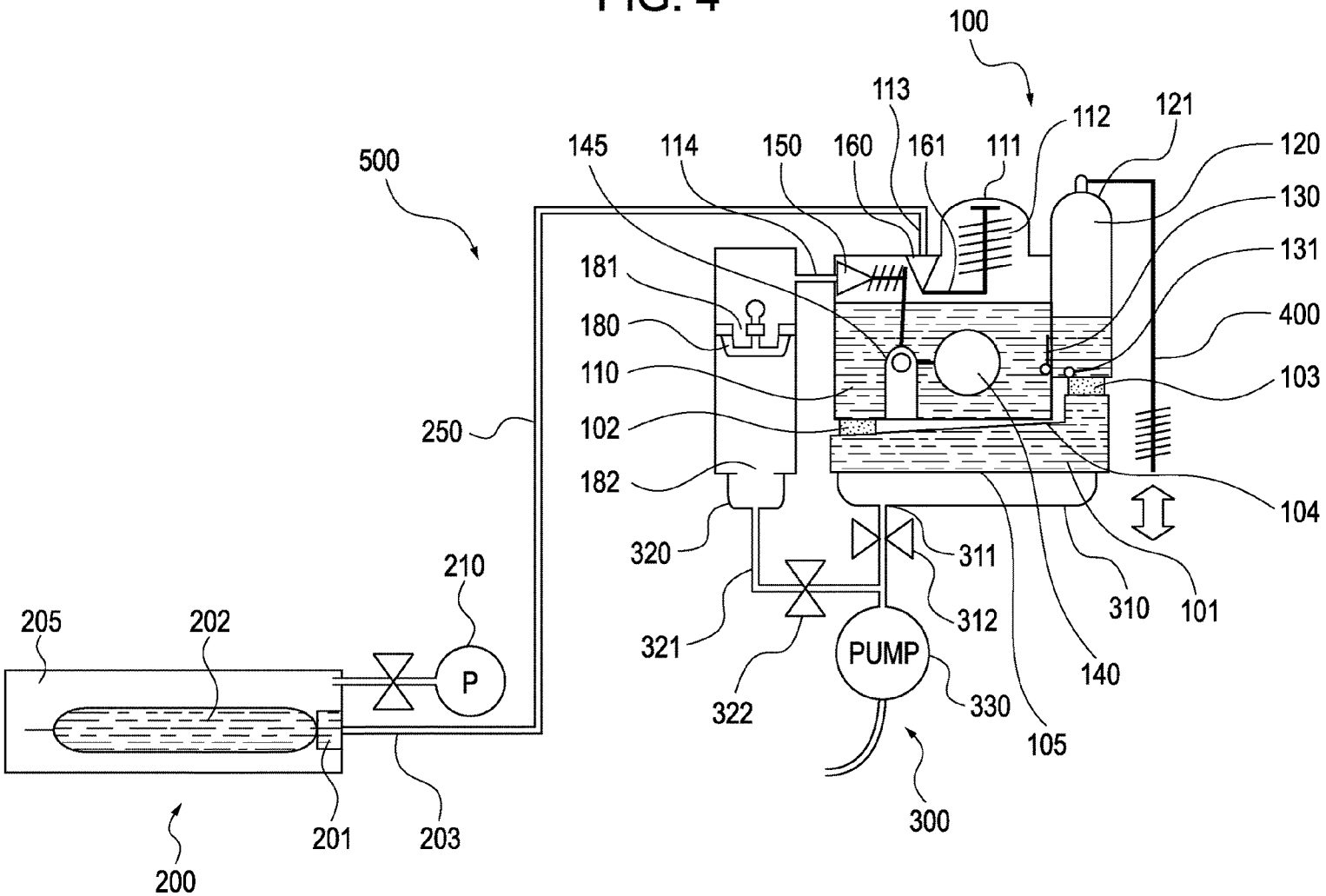
FIG. 4 shows a state in which a recording head has been filled with ink in a first embodiment.

Continuing the air removal operation makes the ink in the first liquid chamber 101 flow into the pump chamber 120. When a predetermined amount of ink has been stored in the pump chamber 120 as shown in FIG. 4, the air removal operation is ended.

Next, the first on-off valve 312 is opened for a predetermined time, and the nozzles are sucked until some amount of ink is discharged from the ejection ports 105A. This forms a meniscus of ink in each of the ejection ports 105A.

In this way, the initial filling operation is completed.

Figure 5:
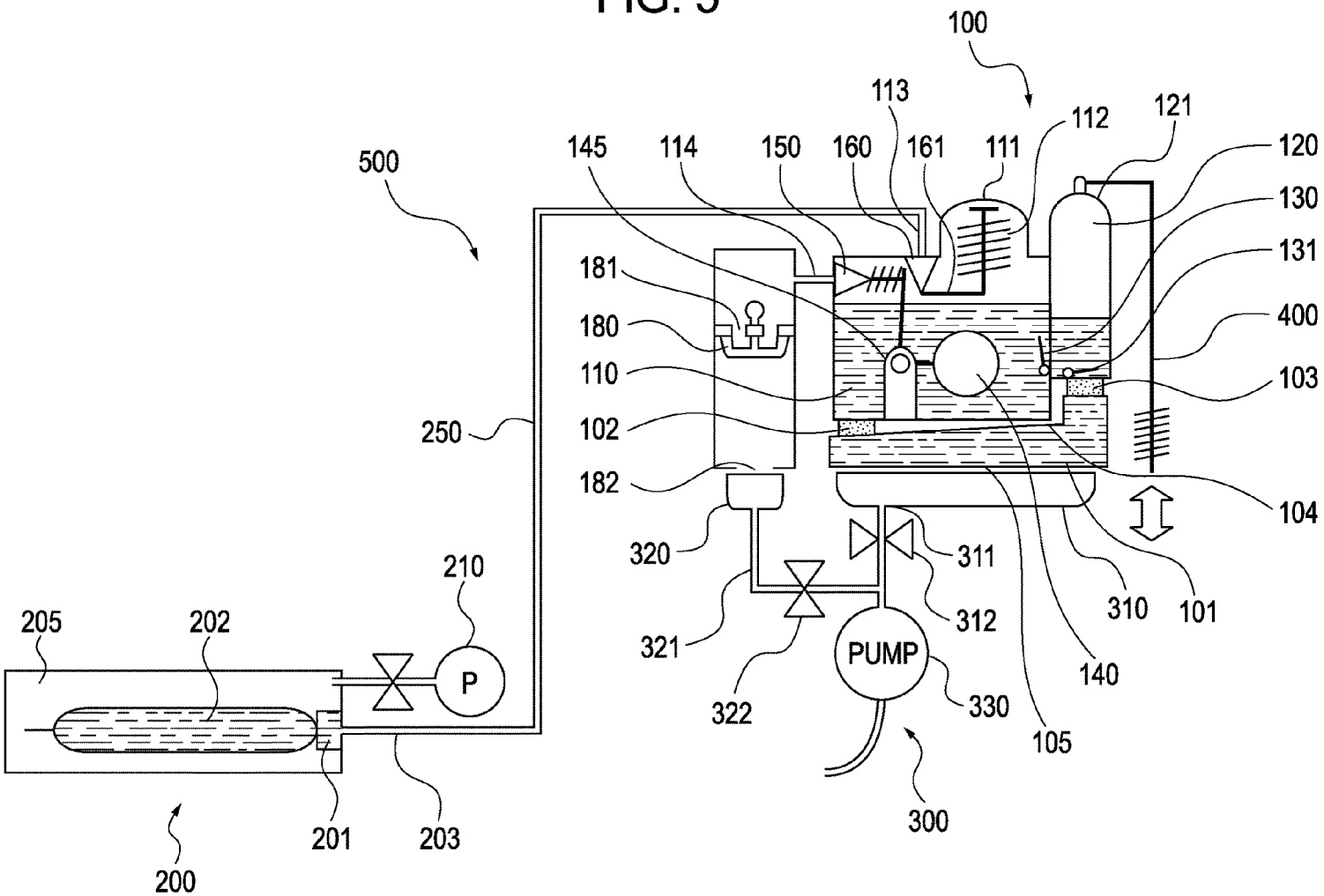
FIG. 5 shows a state in which a recording head has been filled with ink and is capable of recording in a first embodiment.

As shown in FIG. 5, the air vent cap 320 is removed from the air vent port 182, and the suction cap 310 is removed from the ejection port surface, so as to enable recording.

The suction of ink out of the ejection ports may be performed at the stage of FIG. 3 or during the air removal operation.

Entry of Air

The recording head 100 is expected to semipermanently eject ink. If all of the ink in the ink tank 200 is ejected through the tube 250 from the ejection ports 105A of the recording head 100, ejection of ink can be performed again by replacing the ink tank 200.

When the ink tank 200 is replaced, the open end of the ink needle 203 disconnected from the rubber plug 201 is exposed to the atmosphere, and air enters the ink needle 203. A new ink tank is connected to the ink needle 203 and the supply of ink is resumed. The air that has entered the ink needle 203 during replacement of the ink tank is sent through the tube 250 to the recording head.

Air that has entered the tube 250 through the wall surface of the tube 250 is sent into the recording head 100 together with ink during a recording operation. A small amount of air enters the first liquid chamber 101.

Figure 6:
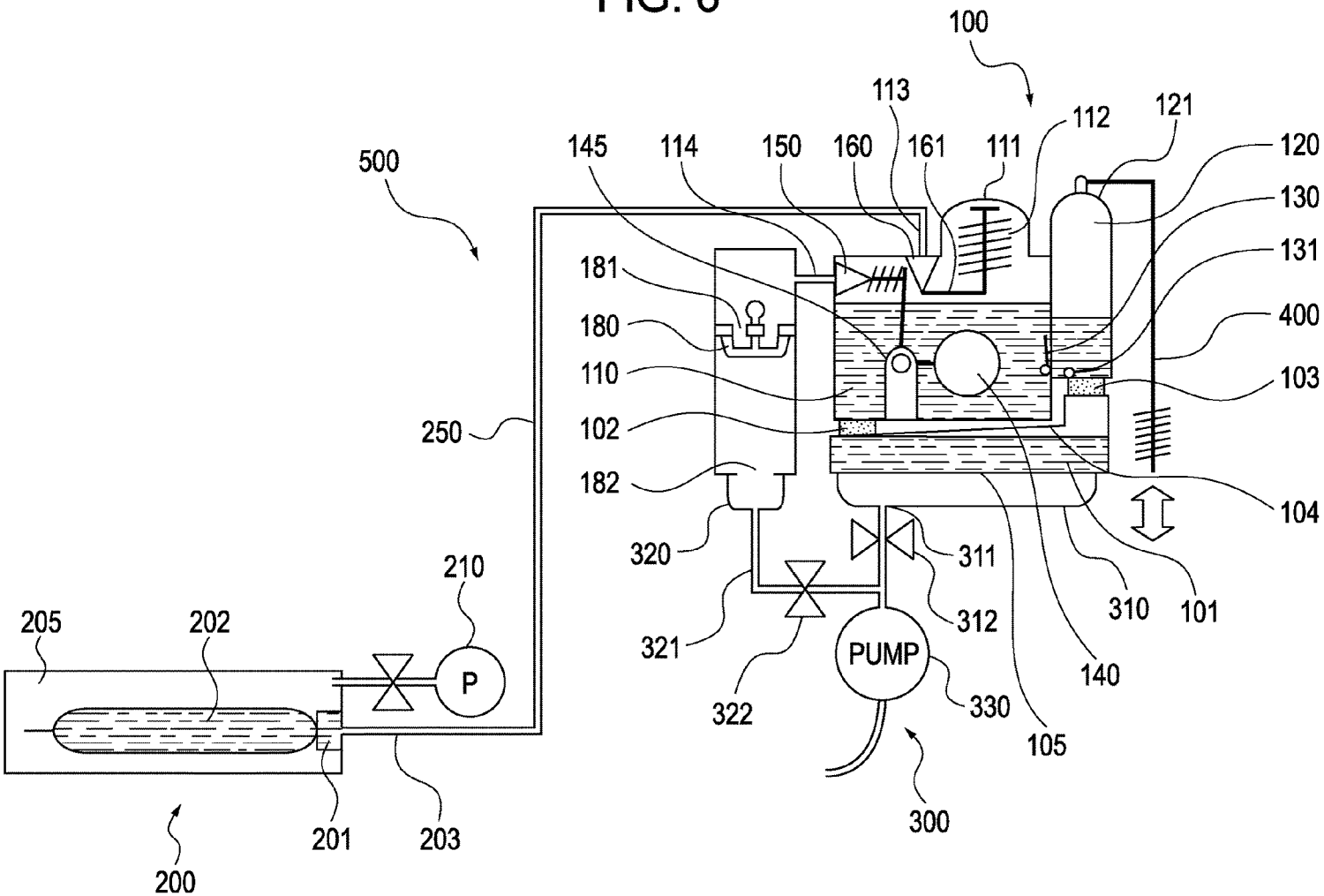
FIG. 6 shows a state in which air has accumulated in a first liquid chamber in a first embodiment.

Air bubbles that enter the ink supply system and are sent to the recording head, air bubbles sucked through the ejection ports 105A of the orifice plate 105 during an ink ejection operation, and bubbles formed by the air dissolved in ink, accumulate in the first liquid chamber 101 as shown in FIG. 6. These bubbles move along the sloping surface 104 and accumulate in the gas reservoir 101A below the first outlet 103.

Air Removal Operation

With reference to FIGS. 7 and 8, the operation to remove air from the first liquid chamber 101 will be described.

The operation to remove air from the first liquid chamber 101 is performed by circulating ink through the first liquid chamber 101, the second liquid chamber 110, and the pump chamber 120.

When ink is circulated, the suction cap 310 is brought into contact with the ejection port surface so as to prevent the breakage of meniscuses in the ejection ports 105A of the orifice plate 105.

As shown in FIG. 7, the suction cap 310 is brought into contact with the ejection port surface, and the air vent cap 320 is brought into contact with the air vent port 182.

By driving the recovery system, the arm 400 is vertically reciprocated so as to deform the liquid chamber diaphragm 121. Deforming the liquid chamber diaphragm 121 changes the volume of the pump chamber 120 and the pressure in the pump chamber 120.

As shown in FIG. 7, the arm 400 is raised by a cam (not shown), and the liquid chamber diaphragm 121 is deformed so as to increase the volume of the pump chamber 120. The pressure in the pump chamber 120 decreases, the second one-way valve 130 closes, and the first one-way valve 131 opens. Since the pressure in the pump chamber 120 is lower than the first negative pressure state, the ink below the outlet filter 103A of the first outlet 103 moves through the first one-way valve 131 into the pump chamber 120. If air is accumulated in the gas reservoir 101A below the outlet filter 103A, instead of ink, air moves to the pump chamber 120.

Next, as shown in FIG. 8, the arm 400 is lowered by the cam (not shown), and the liquid chamber diaphragm 121 is deformed so as to decrease the volume of the pump chamber 120. The pressure in the pump chamber 120 increases, the first one-way valve 131 closes, the second one-way valve 130 opens, and the ink or air in the pump chamber 120 moves to the second liquid chamber 110.

The arm 400 lowers again, and the pressure in the pump chamber 120 increases. The first one-way valve 131 closes, and the second one-way valve 130 opens. The air that has moved from the first liquid chamber 101 moves to the second liquid chamber 110.

By circulating ink through the first liquid chamber 101, the pump chamber 120, the pump chamber 120, and the pump chamber 120, in this order, the air moving together with ink is accumulated in the upper part of the second liquid chamber 110.

Figure 9:
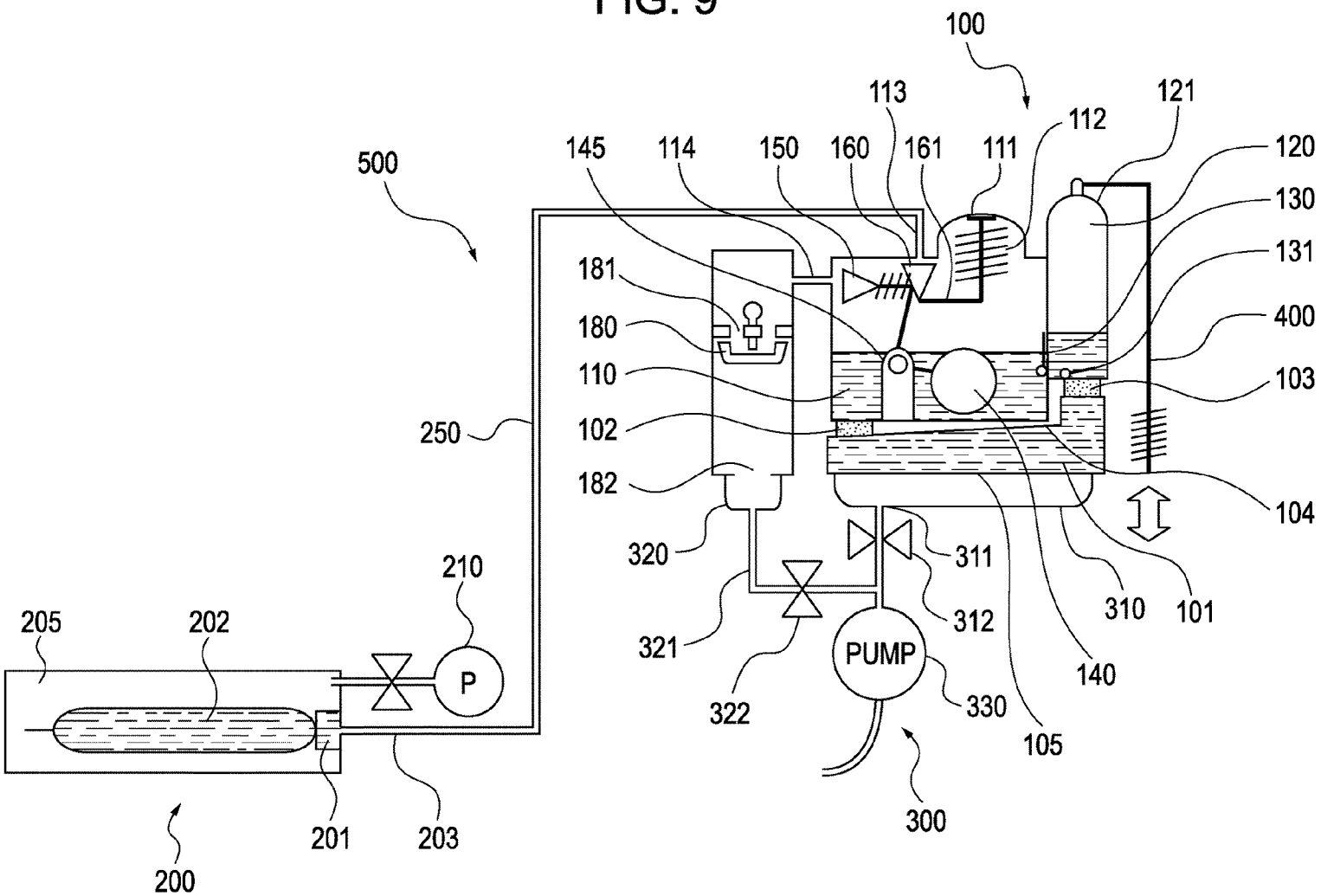
FIG. 9 shows an operation to remove air accumulated in a second liquid chamber in a first embodiment.

The liquid chamber diaphragm 121 is repeatedly raised and lowered, and movement of air gradually lowers the level of ink in the second liquid chamber 110. As shown in FIG. 9, the float 140 falls, and the float valve 150 opens.

The second on-off valve 322 is opened, and the pump 330 is driven. The air vent port 182 connected to the air vent cap 320 is put under negative pressure, and the umbrella valve 180 lowers to open. The air vent flow passage 181 comes into communication with the air vent cap 320 under negative pressure, and the air in the second liquid chamber 110 is discharged through the air vent flow passage 181, the air vent cap 320, and the second flow passage 321.

As the air is discharged by the suction through the air vent cap 320, the second liquid chamber 110 is put under negative pressure. The liquid chamber diaphragm 111 is deformed, and the supply control valve 160 opens. Ink is supplied from the ink tank 200 to the second liquid chamber 110.

Second Embodiment

Figure 11:
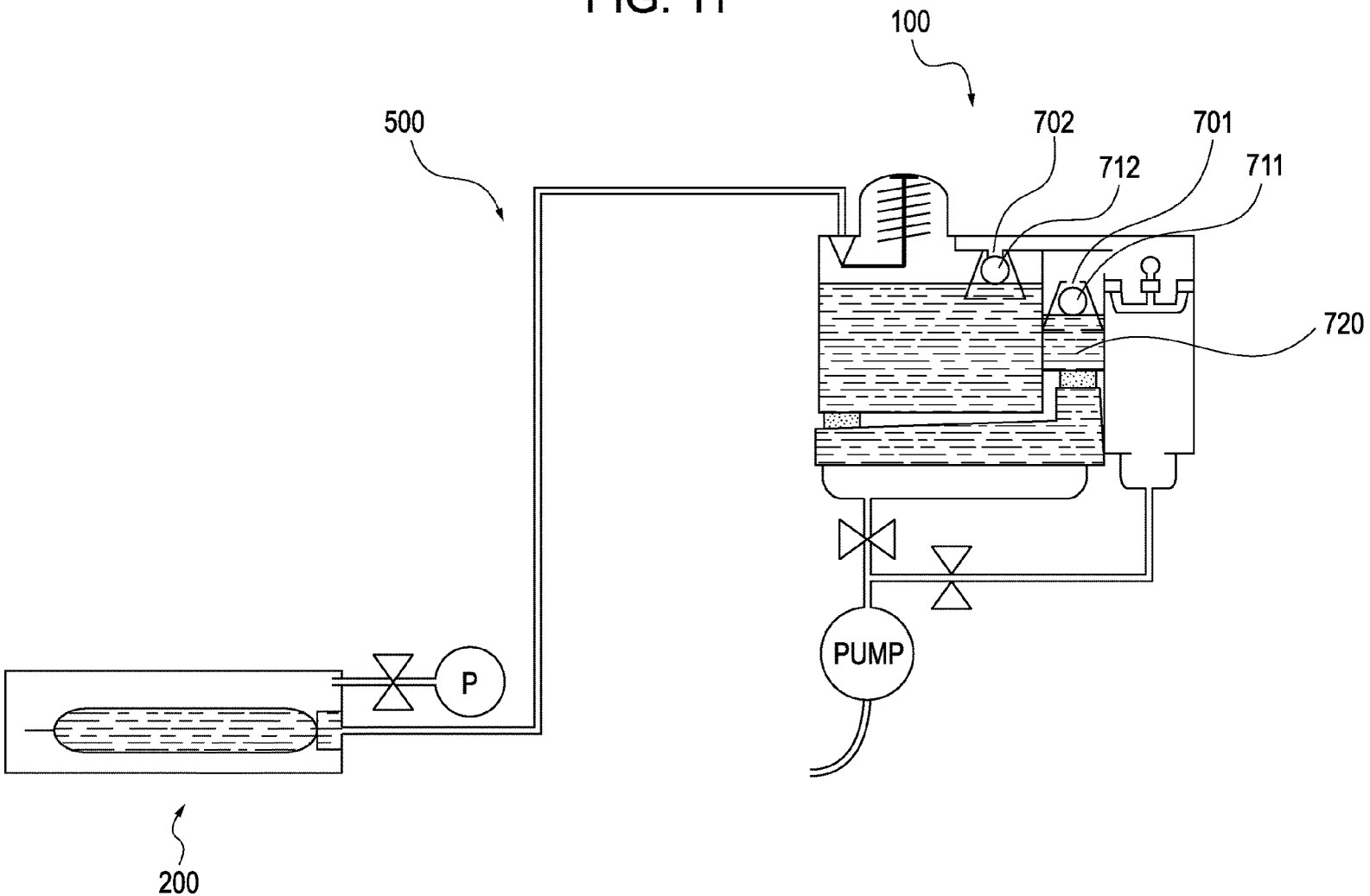
FIG. 11 illustrates a second embodiment of the present invention.

FIG. 11 illustrates a second embodiment.

The first liquid chamber 101 of the recording head is provided with a first outlet 701 for discharging accumulated air. The second liquid chamber 110 is provided with a second outlet 702 for discharging accumulated air.

The first outlet 701 and the second outlet 702 are provided with a first float valve and a second float valve, respectively, that each serve as a gas-liquid separator.

The first float valve includes a seal surface formed on the edge of the opening of the first outlet 701, and a first float member 711 that is pressed against the seal surface by the buoyancy of ink to close the first outlet 701.

The second float valve includes a seal surface formed on the edge of the opening of the second outlet 702, and a second float member 712 that is pressed against the seal surface by the buoyancy of ink to close the second outlet 702.

When the amount of ink increases and the level of ink rises while discharging air through the outlets 701 and 702, the float valves close respective outlets before the level of ink rises to the outlets 701 and 702. The float valves reduce the amount of ink in the recording head discharged when air is discharged through the outlets 701 and 702.

A first liquid chamber discharge flow passage 720 is located above the first liquid chamber 101 and has an outlet filter 103A. When the level of liquid in the second liquid chamber 110 and the level of liquid in the first liquid chamber discharge flow passage 720 lower due to accumulation of bubbles, an air removal operation is performed.

The air vent cap 320 is brought into contact with the air vent port 182, and the suction cap 310 is brought into contact with the ejection port surface. By driving the pump 330, air is sucked through the air vent port 182. To permit fluid to flow through the discharge flow passage 181 in the discharge direction, the umbrella valve 180 serving as a discharge control valve opens, and the air vent flow passage 181 is depressurized.

Since the level of ink is low, the float valves 711 and 712 opens the first outlet 701 and 702, respectively, and the first liquid chamber 101 and the second liquid chamber 110 are also depressurized.

By depressurizing the second liquid chamber 110, the liquid chamber diaphragm 111 is contracted so as to reduce the volume of the second liquid chamber 110. The supply control valve 160 is opened by the arm 161 that moves with the deformation of the liquid chamber diaphragm 111.

By opening the supply control valve 160, ink is supplied from the tube 250 to the second liquid chamber 110 and the first liquid chamber 101. At the same time, air is discharged through the outlets 701 and 702. As ink is supplied, the level of ink rises, and the float members 711 and 712 also rise. The float members 711 and 712 come into close contact with the seal surfaces of the outlets 701 and 702, respectively, to close the outlets 701 and 702, respectively. The discharge of air is stopped, and the discharge of ink is blocked. In this way, only air is discharged, and the discharge of ink is prevented.

Third Embodiment

Figure 12:
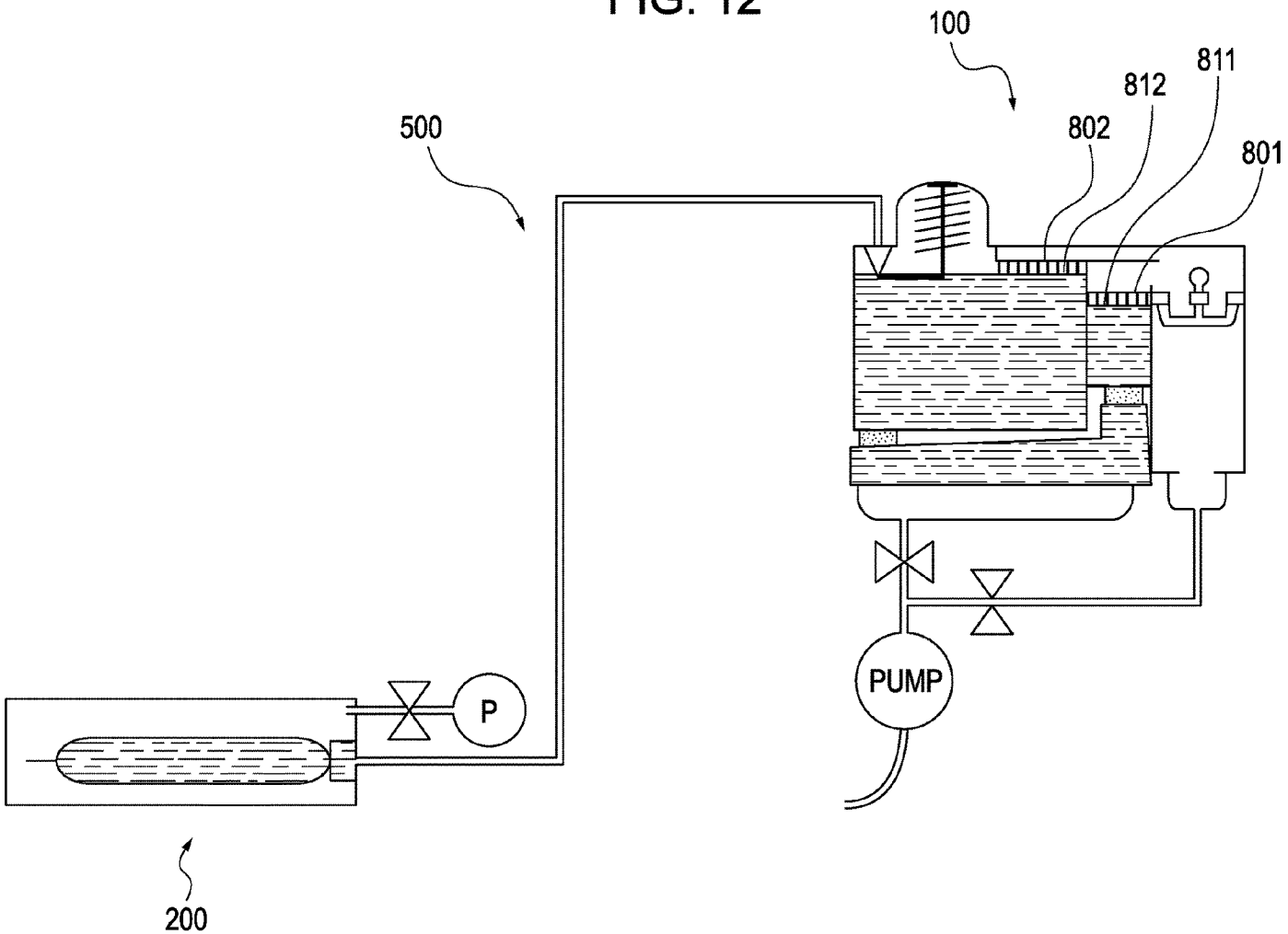
FIG. 12 illustrates a third embodiment of the present invention.

FIG. 12 illustrates a third embodiment.

In the third embodiment, instead of float valves, semipermeable membranes are used as gas-liquid separators.

A first outlet 801 provided in the first liquid chamber 101 and a second outlet 802 provided in the second liquid chamber 110 are blocked by a first semipermeable membrane (first gas-liquid separator) and a second semipermeable membrane (second gas-liquid separator), respectively. The semipermeable membranes permit gas to pass therethrough but do not permit liquid to pass therethrough.

Also in the third embodiment, air that has accumulated in the second liquid chamber 110 and the first liquid chamber 101 is sucked through the air vent port 182 using the air vent cap 320. The umbrella valve 180 opens, and the air vent flow passage 181 is depressurized.

The semipermeable membranes permit air to pass therethrough. Therefore, when the air vent flow passage 181 is depressurized, air is discharged out of the second liquid chamber 110 and the first liquid chamber 101 into the air vent flow passage 181, and the second liquid chamber 110 and the first liquid chamber 101 are also depressurized.

As the second liquid chamber 110 and the first liquid chamber 101 are depressurized, the liquid chamber diaphragm 111 is deformed, the supply control valve 160 opens, and pressurized ink is supplied through the supply control valve 160 and the tube 250 from the ink tank 200.

When the supply of ink has raised the level of ink to the semipermeable membranes 811 and 812 that cover the outlets 801 and 802, respectively, the discharge of fluid stops because the semipermeable membranes do not permit liquid to pass therethrough.

When the pressure in the second liquid chamber 110 and the first liquid chamber 101 has increased to a predetermined negative pressure, the liquid chamber diaphragm 111 returns to the original shape, the supply control valve 160 closes, and the supply of ink stops.

According to the above-described embodiments, a recording head has an on-off valve that communicates with the outside and a suction unit connectable with the on-off valve. Therefore, air accumulated in the recording head can be removed in a timely manner. Even during high-speed and large-amount recording, trouble in recording due to entry of air can be reduced by discharging air in a timely manner, and the frequency of head replacement can be reduced.

In addition, there is no need to provide a space for a large air reservoir, and therefore a small-footprint recording apparatus can be made without increasing the size of a recording head.

According to the present invention, air that has accumulated in the first liquid chamber and the second liquid chamber can be discharged, and therefore trouble in ejection and trouble in negative pressure generation can be reduced.

In addition, by collecting air that has accumulated in the first liquid chamber and the second liquid chamber, in one place, the air can be efficiently discharged, and therefore the maintenance time can be shortened.

According to the present invention, a recording head has a gas-liquid separator therein, and therefore accumulated air can be removed without wasting ink. Therefore, reduction of operational cost and reduction of the operation for waste liquid disposal are achieved, and usability is improved.

A recording head suitable for large high-speed printers that consume a large amount of ink, can be made.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-160768 filed Jun. 19, 2008, which is hereby incorporated by reference herein in its entirety.

What is claimed is:

1. A recording head comprising:
ejection ports that eject ink;
a first liquid chamber for supplying ink to the ejection ports;
a second liquid chamber for supplying ink to the first liquid chamber;
a gas reservoir disposed in the upper part of the first liquid chamber and collecting gas;
a first outlet through which fluid is discharged out of the gas reservoir;
a pump chamber into which fluid is moved through the first outlet out of the first liquid chamber by producing a pressure difference from the first liquid chamber;
a first one-way valve that permits movement of fluid from the first liquid chamber to the pump chamber and blocks movement of fluid from the pump chamber to the first liquid chamber; and
a second one-way valve that permits movement of fluid from the pump chamber to the second liquid chamber and blocks movement of fluid from the second liquid chamber to the pump chamber.

2. The recording head according to claim 1, wherein the pump chamber has a diaphragm for making the pressure in the pump chamber lower than the pressure in the first liquid chamber.

3. The recording head according to claim 1, wherein the pressure in the pump chamber is made lower than the pressure in the first liquid chamber by driving a driving source connected with the pump chamber.

4. The recording head according to claim 1, wherein the ceiling surface of the first liquid chamber slopes upward toward the gas reservoir.

5. A recording head comprising:
ejection ports that eject ink;
a first liquid chamber for supplying ink to the ejection ports;
a second liquid chamber for supplying ink to the first liquid chamber;
a gas reservoir disposed in the upper part of the first liquid chamber and collecting gas;
a first outlet through which fluid is discharged out of the gas reservoir;
a pump chamber into which fluid is moved through the first outlet out of the first liquid chamber by producing a pressure difference from the first liquid chamber;
a pump for sending fluid from the pump chamber to the second liquid chamber;
a second outlet for discharging fluid out of the second liquid chamber;
a discharge flow passage that is connected with the pump and through which fluid is discharged from the second outlet; and
a first discharge control valve capable of opening and closing the second outlet according to the level of liquid in the second liquid chamber.

6. The recording head according to claim 5, wherein the first discharge control valve is a float valve that moves according to the level of liquid in the second liquid chamber.

7. The recording head according to claim 5, further comprising a second discharge control valve that is disposed in the discharge flow passage, that permits movement of fluid from the second outlet to the pump, and that blocks movement of fluid from the pump to the second outlet.

8. The recording head according to claim 7, wherein the second discharge control valve is an umbrella valve that is moved by the pressure in the discharge flow passage.

9. A recording apparatus comprising:
a recording head that ejects ink;
an ink tank that supplies ink to the recording head; and
a tube for supplying ink from the ink tank to the recording head,
wherein the recording head includes ejection ports that eject ink, a first liquid chamber for supplying ink to the ejection ports, a second liquid chamber for supplying ink to the first liquid chamber, a gas reservoir disposed in the upper part of the first liquid chamber and collecting gas, a first outlet through which fluid is discharged out of the gas reservoir, and a pump chamber into which fluid is moved through the first outlet out of the first liquid chamber by producing a pressure difference from the first liquid chamber, a first one-way valve that permits movement of fluid from the gas reservoir to the pump chamber and blocks movement of fluid from the pump chamber to the gas reservoir, and a second one-way that valve permits movement of fluid from the pump chamber to the second liquid chamber and blocks movement of fluid from the second liquid chamber to the pump chamber.

* * * * *